US006834702B2

(12) United States Patent
Nien

(10) Patent No.: US 6,834,702 B2
(45) Date of Patent: Dec. 28, 2004

(54) BLIND ASSEMBLY

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/378,834

(22) Filed: Mar. 5, 2003

(65) Prior Publication Data

US 2004/0103996 A1 Jun. 3, 2004

(30) Foreign Application Priority Data

Dec. 2, 2002 (TW) ..... 91219747 U

(51) Int. Cl.[7] ..... E06B 9/30

(52) U.S. Cl. ..... 160/178.1 R; 160/89

(58) Field of Search ..... 160/178.1 R, 84.03, 160/84.05, 84.01, 89, 166.1 R, 173 R, 236

(56) References Cited

U.S. PATENT DOCUMENTS

| | | | | | |
|---|---|---|---|---|---|
| 5,490,553 | A | * | 2/1996 | Colson et al. | 160/84.06 |
| 5,638,881 | A | * | 6/1997 | Ruggles et al. | 160/168.1 V |
| 5,845,690 | A | * | 12/1998 | Colson et al. | 160/84.01 |
| 6,105,657 | A | * | 8/2000 | Zorbas | 160/236 |
| 6,257,300 | B1 | * | 7/2001 | Brownlie | 160/84.01 |
| 6,431,245 | B1 | * | 8/2002 | Shen | 160/84.03 |
| 6,502,619 | B1 | * | 1/2003 | Kraeutler | 160/84.01 |
| 6,675,859 | B2 | * | 1/2004 | Nien | 160/89 |
| 2003/0178153 | A1 | * | 9/2003 | Senesac | 160/89 |

FOREIGN PATENT DOCUMENTS

| | | | | |
|---|---|---|---|---|
| BE | 1013585 | * | 7/2000 | 160/84.01 X |
| GB | 2140490 | * | 11/1984 | 160/85.05 X |

* cited by examiner

*Primary Examiner*—Bruce A. Lev
(74) *Attorney, Agent, or Firm*—Bacon & Thomas, PLLC

(57) ABSTRACT

The assembly includes a blind formed of a headrail, a bottom rail, slats, two ladder tapes, and shades detachably fastened to the ladder tapes to cover the gaps between the slats. Each shade has an elongated shade body and a support member inserted into a pocket at one side of the shade body.

4 Claims, 9 Drawing Sheets

BLIND ASSEMBLY

BACKGROUND OF THE INVENTION

1. Field of the Invention

The present invention relates generally to blinds and, more particularly, to a blind assembly, which comprises a plurality of shades attached to the blind slats. The invention relates also to shades for blind assembly.

2. Description of the Related Art

In order to enhancing light shading effect and to make the whole assembly more attractive, a Venetian blind may be covered with a curtain. Conventional curtains for Venetian blind commonly have a complicated mounting structure and high manufacturing cost. Further, it takes much time and labor to install a curtain in a Venetian blind. When installed, the curtain and the blind body may not be maintained in balance. Further, when receiving the blind, the curtain tends to be jammed in between the slats and wrinkled. When the border area of the curtain curved or wrinkled, the sense of beauty of the curtain is destroyed. In order to eliminate this problem, the inventor of the present invention invented a combination curtain and blind arrangement (Taiwan Utility Model Application No. 91204734). This design is functional. However, it takes much time to detach the curtain from the blind for cleaning. There is also known a blind assembly having detachable curtains. However, this design has no means to support the curtains in shape. Due to the effect of gravity weight, the middle part of each curtain curves downwards when installed.

SUMMARY OF THE INVENTION

It is the main object of the present invention to provide a blind assembly, which has shades suspended from the slats at one side in a smooth manner.

It is another object of the present invention to provide a blind assembly, which keeps shades positively secured to the slats.

It is still another object of the present invention to provide a blind assembly, which is simple and inexpensive to manufacture.

To achieve these objects of the present invention, the blind assembly comprises a blind and a plurality of shades. The blind comprises a headrail, a bottom rail, a plurality of slats, and two ladder tapes fastened to the headrail and the bottom rail to hold the slats in parallel between the headrail and the bottom rail. The shades are detachably fastened to the ladder tapes to cover the gaps in between the slats. Each shade is comprised of an elongated shade body and a support member. The shade body has a pocket extended along one long side thereof and adapted to accommodate the support member, and a plurality of crevices formed in the pocket corresponding to the ladder tapes. The support member is inserted into the pocket, defining with the crevices a respective retaining space, which receives the ladder tapes.

DETAILED DESCRIPTION OF THE INVENTION

Figure 1:
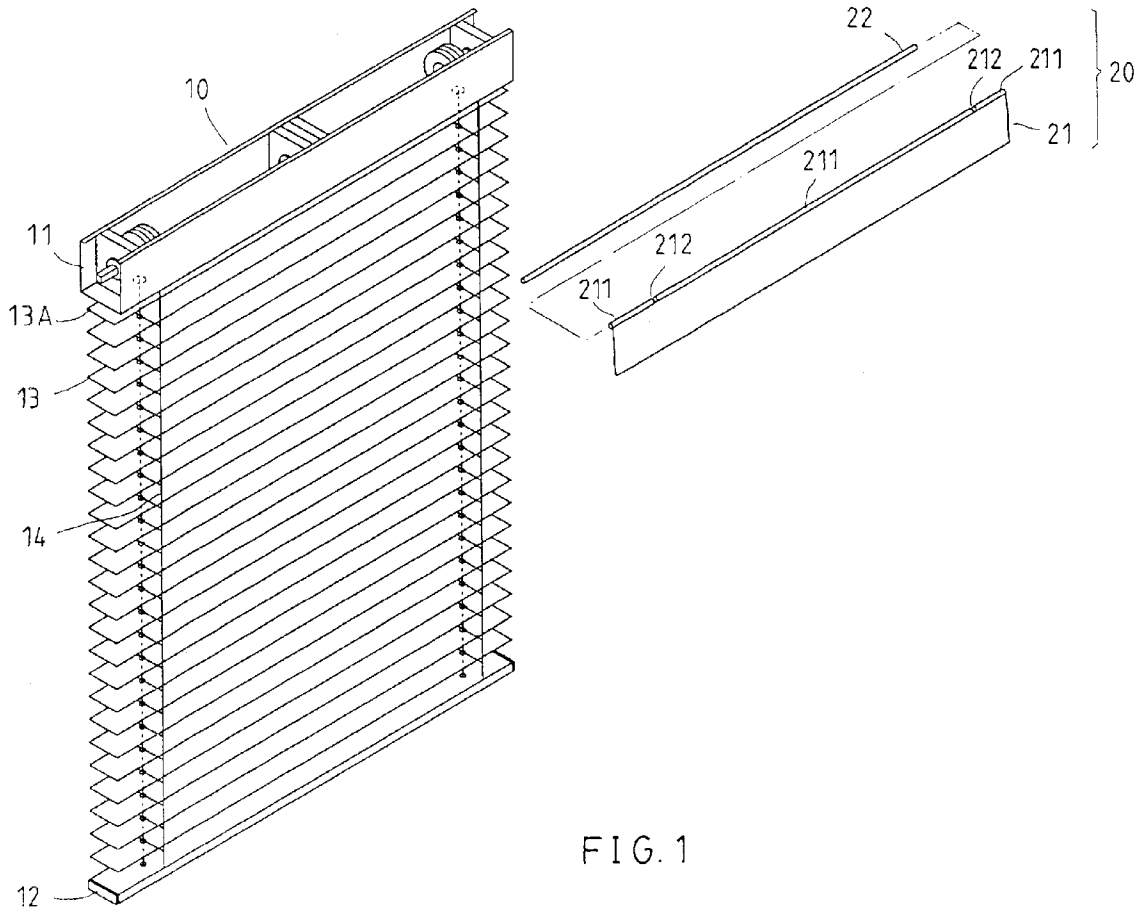
FIG. 1 is a perspective view of an exploded view of a blind assembly according to a first preferred embodiment of the present invention.
Figure 2:
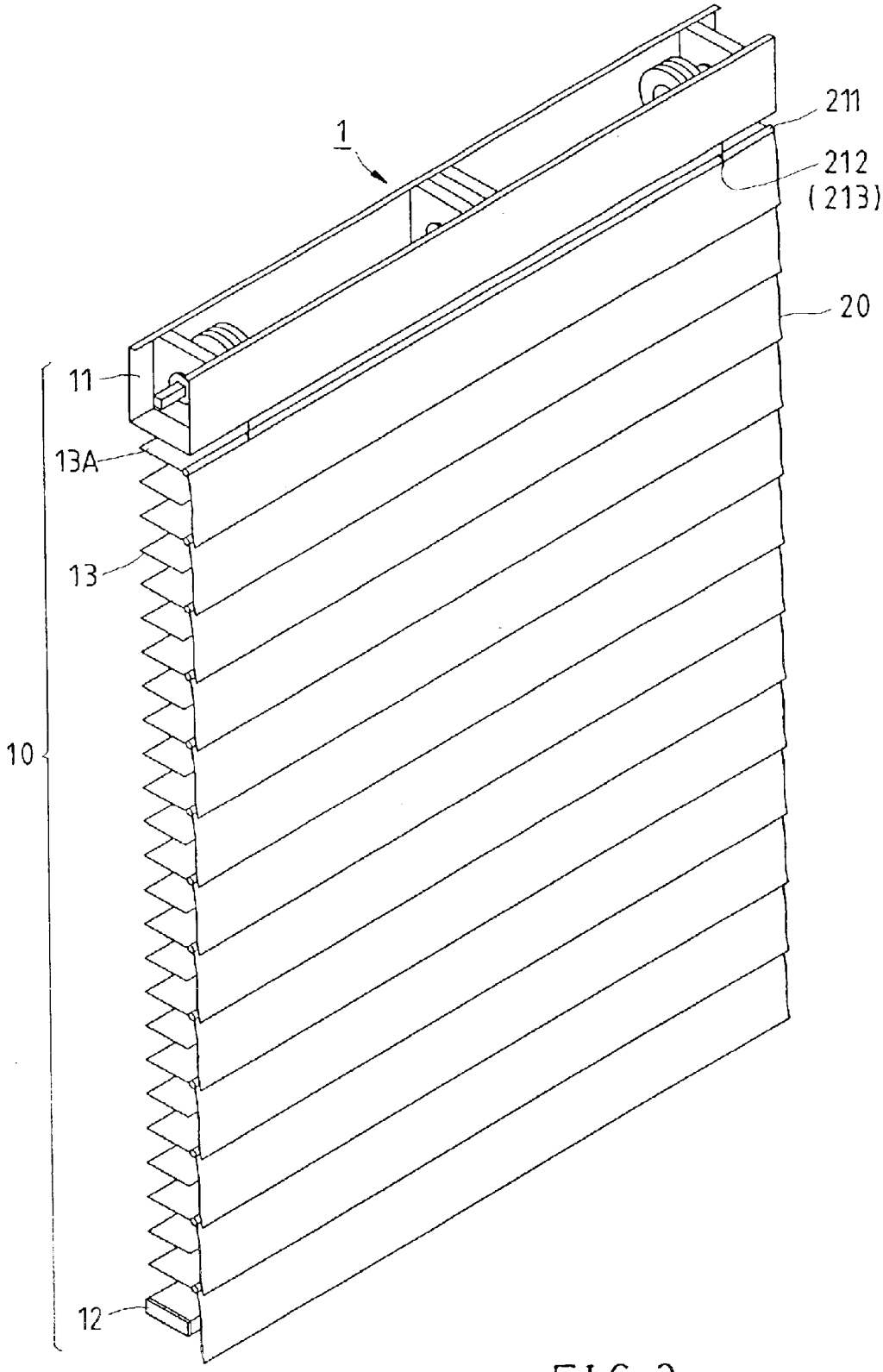
FIG. 2 is an elevational assembly view in an enlarged scale of the blind assembly shown in FIG. 1.

Referring to FIGS. 1 and 2, a blind assembly 1 in accordance with the first preferred embodiment of the present invention is shown comprised of a Venetian blind 10, a number of shades 20.

Figure 3:
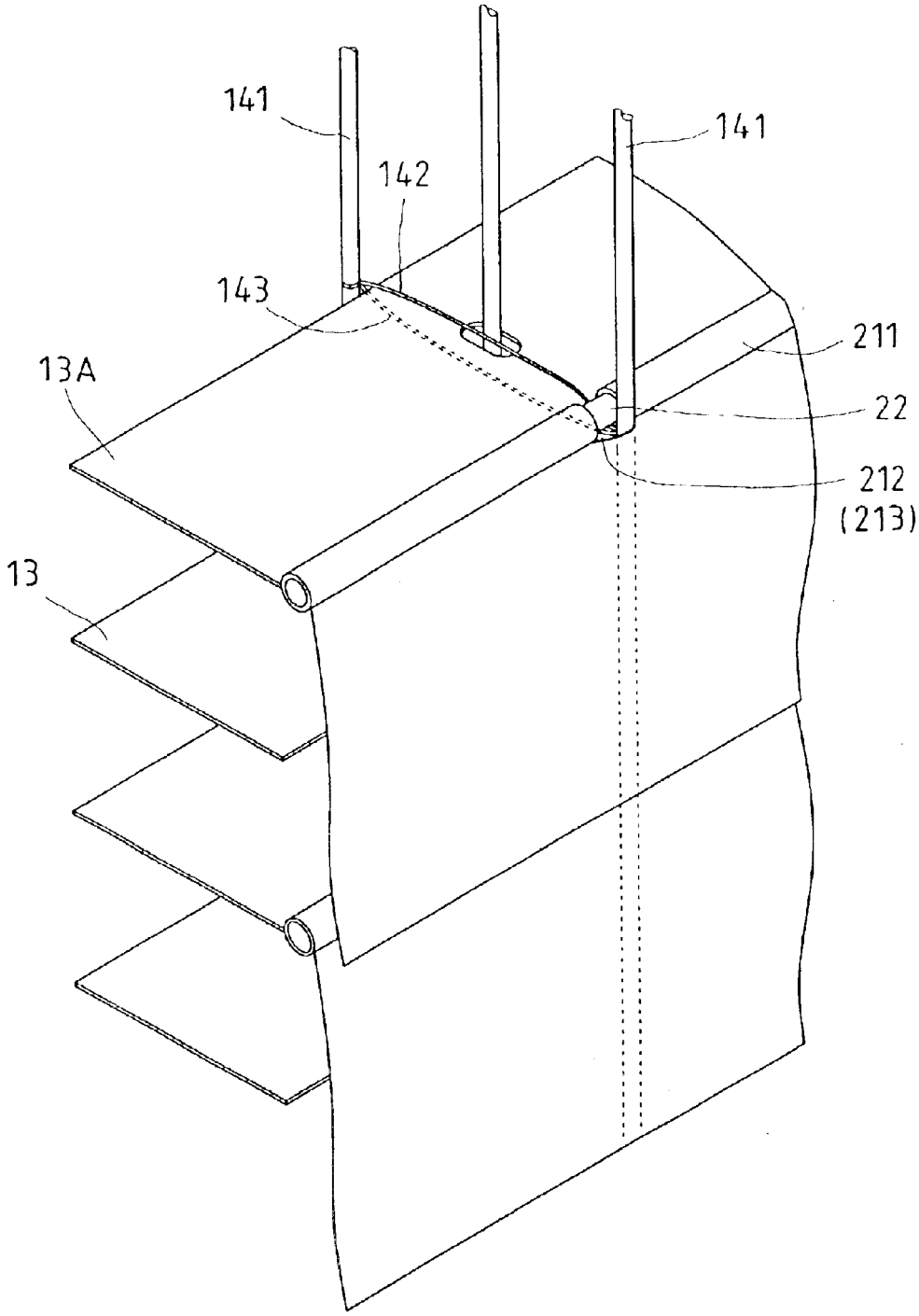
FIG. 3 is an enlarged view of a part of FIG. 2.
Figure 4:
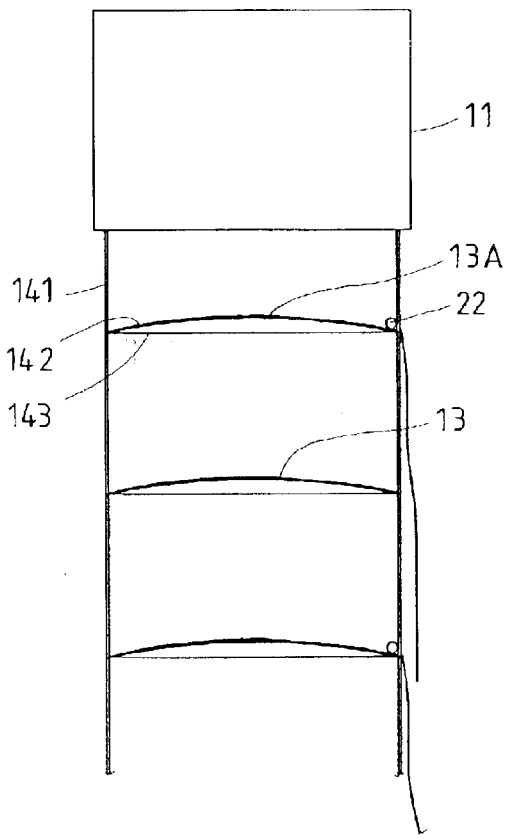
FIG. 4 is a side view in an enlarged scale of a part of FIG. 2.

Referring to FIGS. 3 and 4 and FIGS. 1 and 2 again, the Venetian blind 10 comprises a headrail 11, a bottom rail 12, a number of slats 13, and two ladder tapes 14. The headrail 11 is fixedly fastened to the top side of a window (not shown). The bottom rail 12 is spaced below the headrail 11. The slats 13 are arranged in parallel between the headrail 11 and the bottom rail 12. The ladder tapes 14 each comprise two vertical ladder tape elements 141 connected in parallel between the headrail 11 and the bottom rail 12, a plurality of first horizontal ladder tape elements 142 respectively connected between the vertical ladder tape elements 141 at different elevations, and a plurality of second horizontal ladder tape elements 143 respectively connected between the vertical ladder tape elements 141 at different elevations corresponding to the first horizontal ladder tape elements 142. Each first horizontal ladder tape element 142 forms with one second horizontal ladder tape elements 143 a loop for holding one slat 13 or the bottom rail 12, i.e., the first horizontal ladder tape elements 142 and the second horizontal ladder tape elements 143 join the slats 13 between the headrail 11 and the bottom rail 12. When pulling the ladder tapes 14, the slats 13 are tilted.

The number of the shades 20 is one half of the number of the slats 13. Each shade 20 is comprised of a rectangular shade body 21 made from semi-transparent material, and an elongated rigid support member 22. The length of the shade body 21 is equal to the length of the slats 13. The width of the shade body 21 is twice the pitch of the slats 13. The shade body 21 has a pocket 211 extended along one long side, and two crevices 212 in the pocket 211 corresponding to the two ladder tapes 14. The support member 22 is inserted into the pocket 211 of the shade body 21. Each crevice 212 defines with the support member 22 a respective retaining space 213 (see FIGS. 3 and 4). The length of the support member 22 is equal to the length of the slats 13. During installation, the pockets 211 of the shade bodies 21 of the shades 20 are respectively attached to the first horizontal ladder tape elements 142 at the odd number slats 13 ($1^{st}$, $3^{rd}$, $5^{th}$, $7^{th}$, etc.), and then the respective support members 22 are respectively inserted into the pockets 211 of the shade bodies 21 of the shades 20, keeping one vertical ladder tape element 141 of each ladder tape 14 respectively secured to the retaining spaces 213.

According to the aforesaid first embodiment of the present invention, the blind assembly has the following advantages:

1. The shades cover the gaps in between the slats, enhancing the light shading effect of the blind. Because the shades are not directly fastened to the slats, the shades will not be wrinkled when lifting the slats to receive the blind assembly.
2. The rigid support members hold the respective shade bodies in shape, preventing the shade bodies from curving downwards.
3. The installation of the shades is easy. When wishing to wash the shades, the user can detach the shades from the ladder tapes by removing the rod members from the shade bodies.

Figure 5:
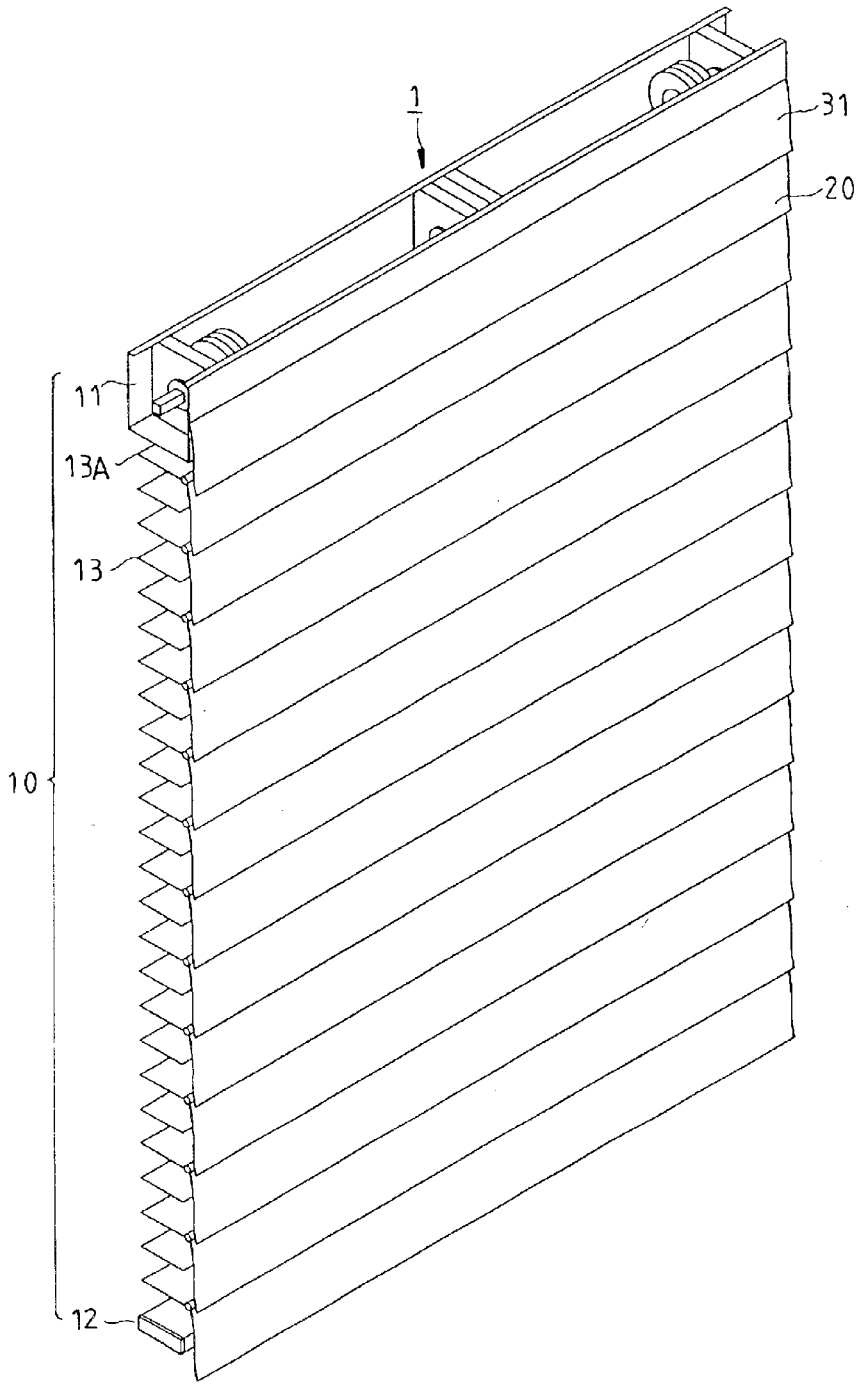
FIG. 5 is a perspective assembly view of a blind assembly according to a second preferred embodiment of the present invention.

FIG. 5 shows a blind assembly constructed according to the second preferred embodiment of the present invention. According to this embodiment, a valance 31 is fastened to the front side of the headrail 11 to cover the gap between the headrail 11 and the first slat 13A.

Figure 8:
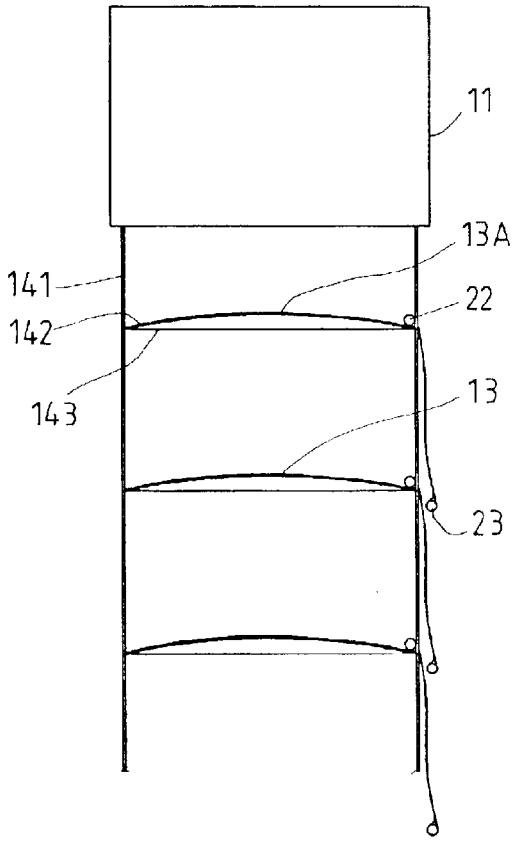
FIG. 8 is a side view in an enlarged scale of a part of FIG. 7.
Figure 6:
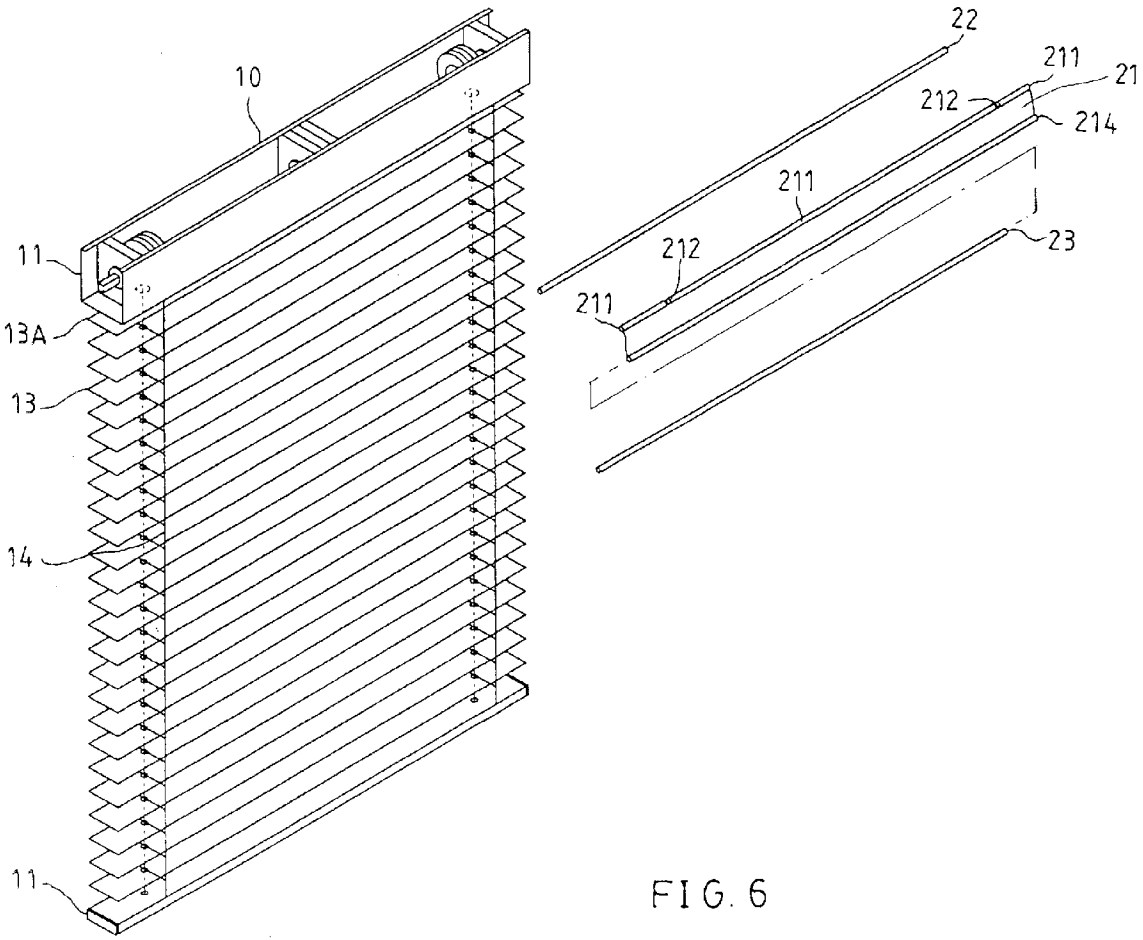
FIG. 6 is an exploded view of a blind assembly according to a third preferred embodiment of the present invention.
Figure 7:
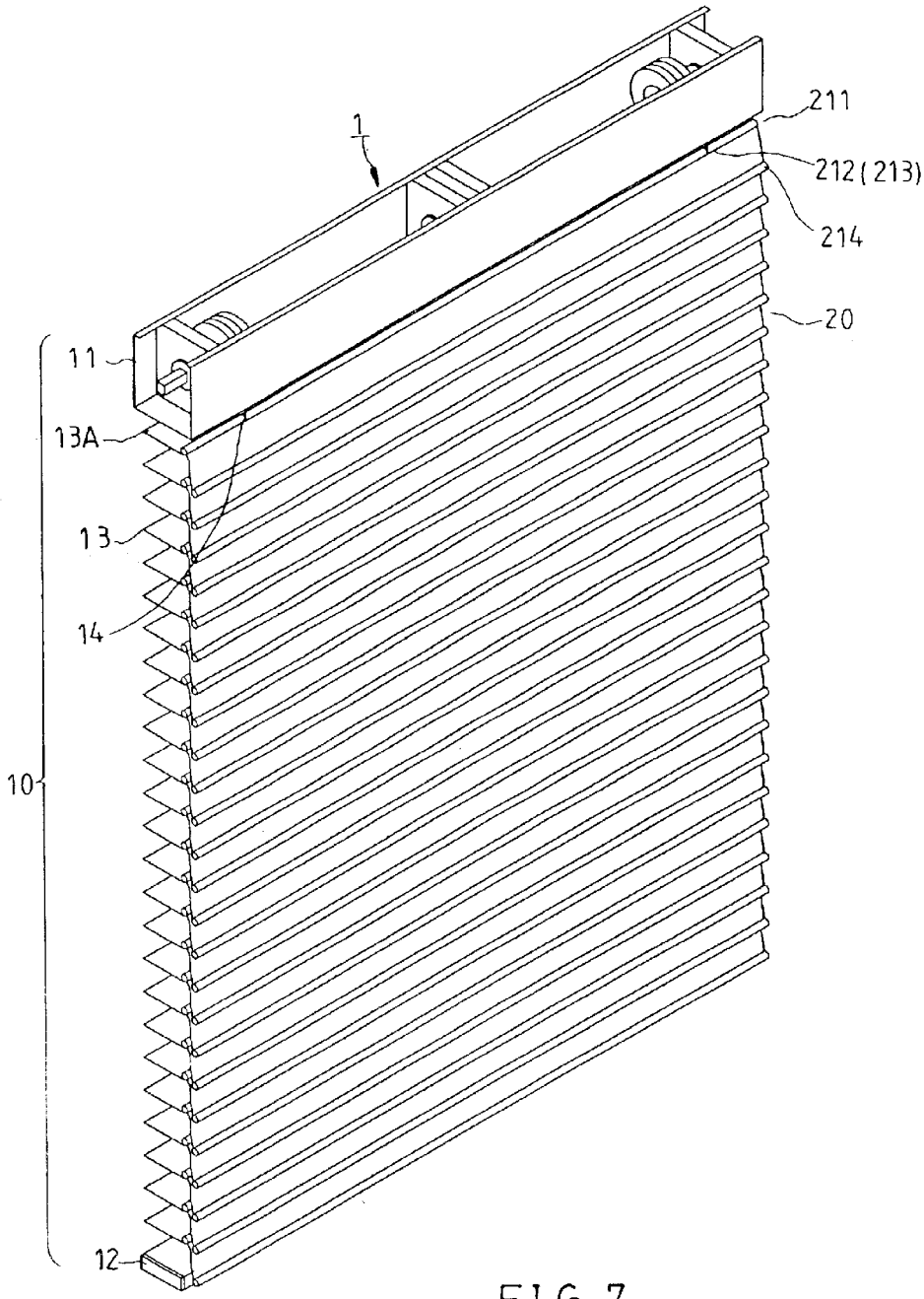
FIG. 7 is a perspective assembly view in an enlarged scale of the blind assembly shown in FIG. 6.

FIGS. 6~8 show a blind assembly constructed according to the third preferred embodiment of the present invention. This embodiment is similar to the aforesaid first embodiment with the exception of the structure of the shades 20. According to this embodiment, each shade 20 further comprises a weight 23. The weight 23 is rod-like member of heavy material. The length of the weight 23 is approximately equal to the lengths of the slats 13. The shade body 21 has a tubular receiving portion 214 extended along the other long side (opposite to the pocket 211) and adapted to receive the weight 23. Further, the number of the shades 20 is equal to the number of the slats 13, and the length of the short sides of the shades 20 is approximately equal to the pitch of the slats 13. During installation, the pockets 211 of the shade bodies 21 of the shades 20 are respectively attached to the first horizontal ladder tape elements 142 at the slats 13, and then the respective support members 22 are respectively inserted into the pockets 211 of the shade bodies 21 of the shades 20, keeping one vertical ladder tape element 141 of each ladder tape 14 respectively secured to the retaining spaces 213. Because the shade body 21 of each shade 20 is equipped with a respective weight 23, the shade bodies 21 of the shades 20 do not fly in the air. Further, the weights 23 give a downward traction effort to the respective shade bodies 21, preventing the shade bodies 21 from curving due to the radiation of sunlight.

Figure 9:
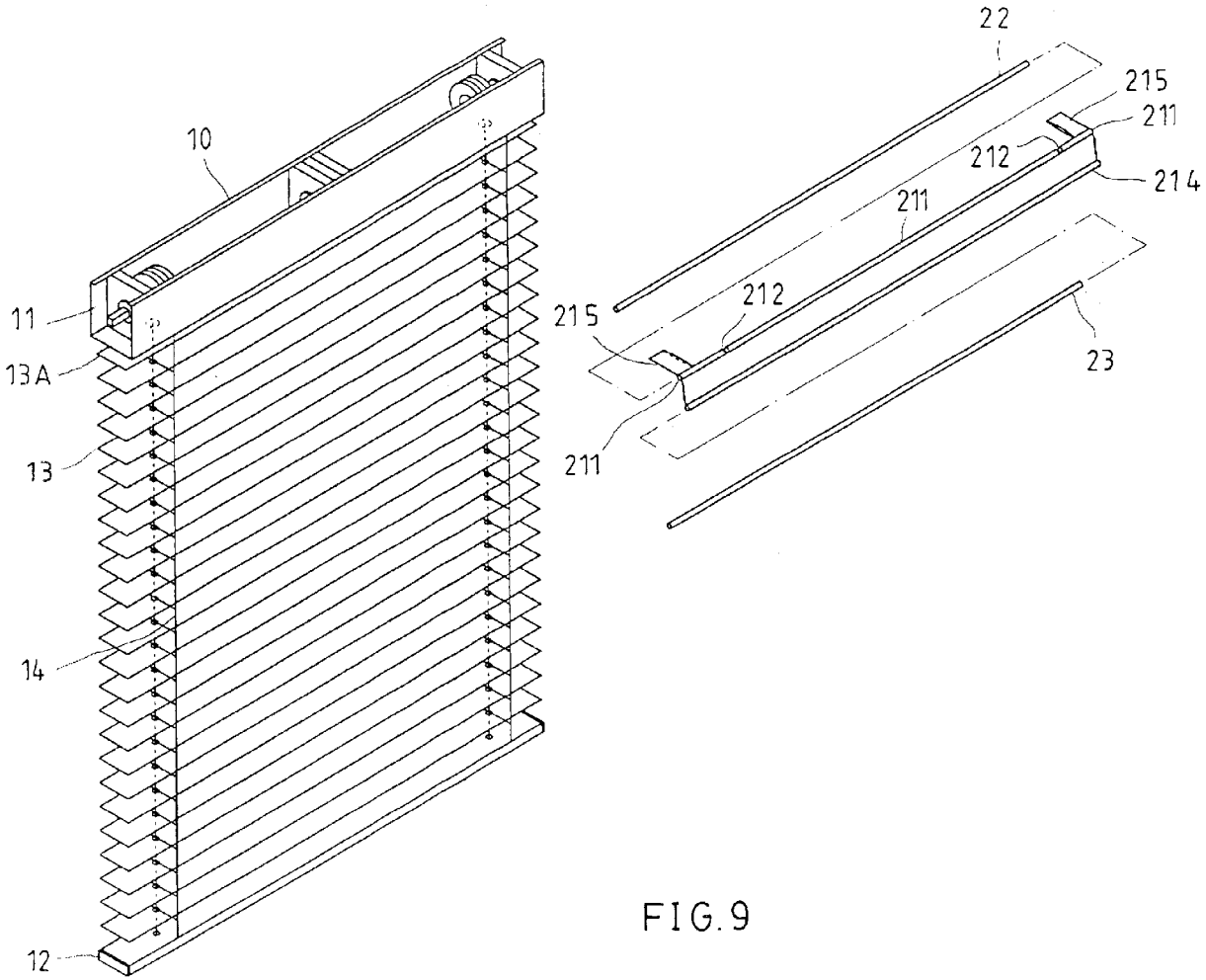
FIG. 9 is an exploded view of a blind assembly according to a fourth preferred embodiment of the present invention.
Figure 10:
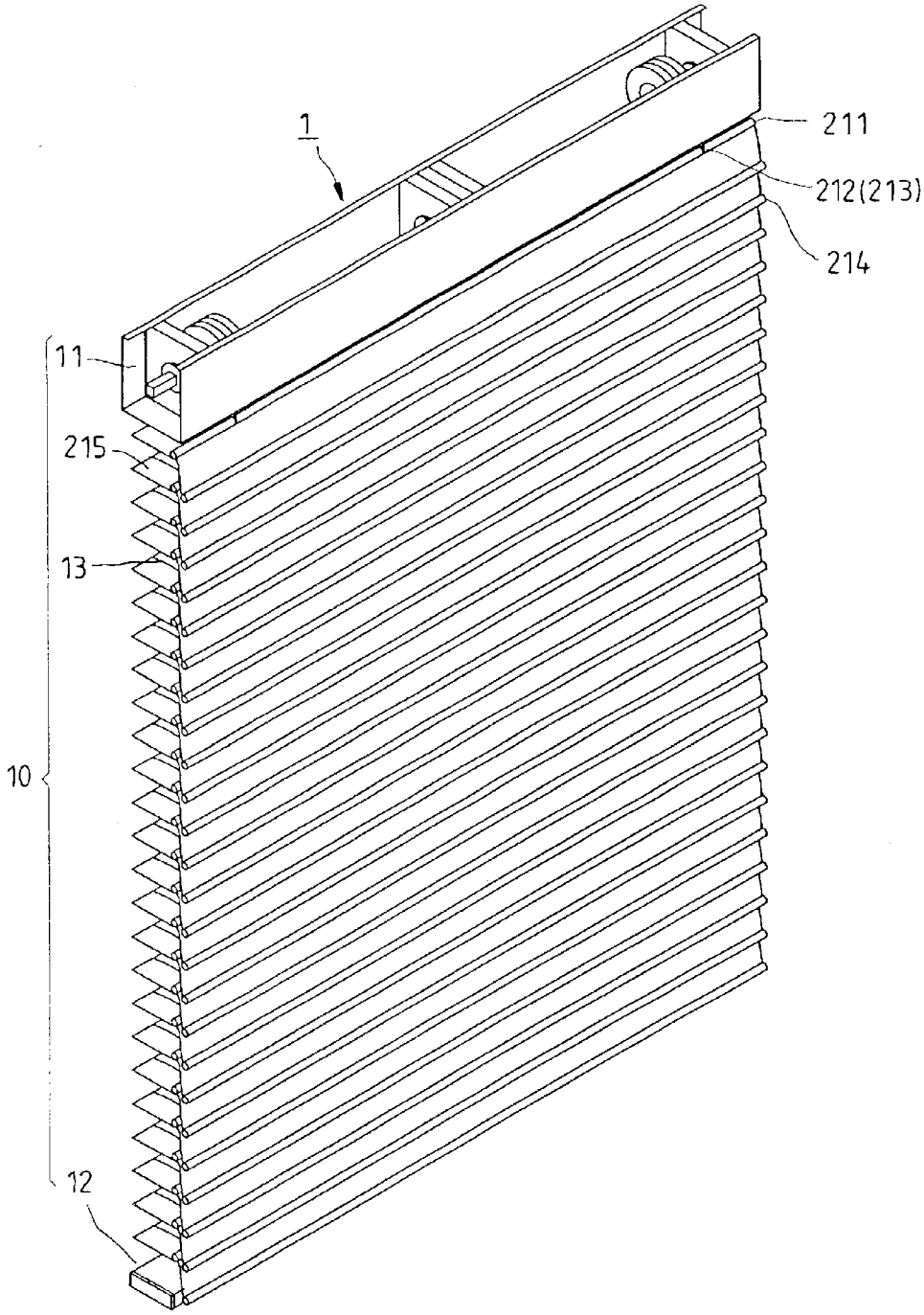
FIG. 10 is a perspective assembly view in an enlarged scale of the blind assembly shown in FIG. 9.

FIGS. 9 and 10 show a blind assembly constructed according to the fourth preferred embodiment of the present invention. This embodiment is similar to the aforesaid third embodiment with the exception of the structure of the shades 20. According to this embodiment, each shade 20 further comprises two coupling loops 215 extended from the two distal ends of the periphery of the pocket 211 for coupling to one slat 13. By means of sleeving the coupling loops 215 onto the slats 13, the shades 20 are closely secured to the slats 13 in a good order.

What is claimed is:

1. A blind assembly comprising:

a blind having a headrail, a bottom rail, a plurality of slats, and two ladder tapes fastened to said headrail and said bottom rail to hold said slats in parallel between said headrail and said bottom rail; and a plurality of shades fastened to said ladder tapes and adapted to cover gaps in between said slats, said shades each having an elongated shade body and a support member, said shade body having a pocket substantially extended a length equal to the length of the support member and adapted to accommodate said support member, and a plurality of crevices formed in said pocket corresponding to said ladder tapes, said support member having a length substantially equal to said shade body, said support member being inserted into said pocket and defining with said crevices a respective retaining space, which receives said ladder tapes, and the ladder tapes are retained within the retaining spaces and the shades are secured to the blind at the retaining spaces.

2. The blind assembly as claimed in claim 1, wherein each said shade further comprises a rod-shaped weight, said rod-shaped weight having a length substantially equal to the length of said support member; the shade body of each of said shades has a tubular receiving portion elongated a distance substantially equal to the length of the rod-shaped weight opposite to the respective pocket and adapted to accommodate said rod-shaped weight.

3. The blind assembly as claimed in claim 1, wherein said shade body further comprises two coupling loops respectively extended from two distal ends of the periphery of the pocket thereof and respectively coupled to one of said slats.

4. The blind assembly as claimed in claim 1, wherein said ladder tapes each comprise two vertical ladder tape elements connected in parallel between said headrail and said bottom rail, and a plurality of first horizontal ladder tape elements respectively connected between said vertical ladder tape elements at different elevations, and a plurality of second horizontal ladder tape elements respectively connected between said vertical ladder tape elements at different elevations corresponding to said first horizontal ladder tape elements, said first horizontal ladder tape elements each forming with said second horizontal ladder tape elements a respective loop for holding said slats.

* * * * *